US009810493B2

(12) United States Patent
Fluhr et al.

(10) Patent No.: US 9,810,493 B2
(45) Date of Patent: Nov. 7, 2017

(54) BOLT RELEASES AND FIREARMS INCLUDING SUCH BOLT RELEASES

(71) Applicant: HECKLER & KOCH GmbH, Oberndorf (DE)

(72) Inventors: Norbert Fluhr, Oberndorf (DE); Daniel Kohler, Oberndorf-Boll (DE)

(73) Assignee: Heckler & Koch GmbH, Oberndorf (DE)

( * ) Notice: Subject to any disclaimer, the term of this patent is extended or adjusted under 35 U.S.C. 154(b) by 245 days.

(21) Appl. No.: 14/656,688

(22) Filed: Mar. 12, 2015

(65) Prior Publication Data

US 2016/0258696 A1 Sep. 8, 2016

Related U.S. Application Data

(63) Continuation of application No. PCT/EP2013/002910, filed on Sep. 27, 2013.

(30) Foreign Application Priority Data

Oct. 2, 2012 (DE) ..... 10 2012 019 422

(51) Int. Cl.
*F41C 23/00* (2006.01)
*F41A 3/42* (2006.01)
(Continued)

(52) U.S. Cl.
CPC *F41A 3/42* (2013.01); *F41A 3/66* (2013.01); *F41A 17/42* (2013.01); *F41A 35/06* (2013.01)

(58) Field of Classification Search
CPC .. F41A 3/42; F41A 17/36; F41A 17/42; F41A 35/06; F41A 3/66
(Continued)

(56) References Cited

U.S. PATENT DOCUMENTS 6,212,814 B1 * 4/2001 Lambie ..... F41A 11/02 42/75.03
6,722,253 B2 * 4/2004 Johnson ..... F41A 3/12 42/90
(Continued)

FOREIGN PATENT DOCUMENTS

DE 1890933 4/1964
DE 10008979 9/2001
(Continued)

OTHER PUBLICATIONS

International Searching Authority, "Written Opinion", issued in connection with PCT Application No. PCT/EP2013/002910, dated Dec. 17, 2013, including English translation, 10 pages.
(Continued)

*Primary Examiner* — Michelle R Clement
(74) *Attorney, Agent, or Firm* — Hanley, Flight & Zimmerman, LLC

(57) ABSTRACT

Magazine release apparatus and firearms including such magazine release apparatus are disclosed. An example bolt release for use with a firearm includes a first handle to protrude from a first side of the firearm and a second handle to protrude from a second side of the firearm. The first and second handles are integral. The first and second handles are to enable the bolt release to be operable from the first and second sides of the firearm. The bolt release includes a pivot axis adjacent the first side or the second side. The pivot axis is to enable the bolt release to be pivoted between a release position and a retained position. The bolt release to be biased toward the release position.

23 Claims, 6 Drawing Sheets

(51) Int. Cl.
*F41A 17/42* (2006.01)
*F41A 35/06* (2006.01)
*F41A 3/66* (2006.01)

(58) Field of Classification Search
USPC ..... 42/71.02
See application file for complete search history.

(56) References Cited

U.S. PATENT DOCUMENTS 6,763,755 B2 * 7/2004 Johnson ..... F41A 3/12 42/90
6,851,346 B1 * 2/2005 Herring ..... F41A 5/26 89/1.4
6,901,837 B2 * 6/2005 Johnson ..... F41A 3/12 42/90
7,661,219 B1 * 2/2010 Knight, Jr. ..... F41A 3/42 42/17
8,161,861 B2 * 4/2012 Haley ..... F41A 17/42 89/1.4
8,261,652 B2 * 9/2012 Findlay ..... F41A 17/36 42/70.02
8,359,966 B1 * 1/2013 Brotherton ..... F41A 3/68 42/70.02
8,695,477 B2 * 4/2014 Esch ..... F41A 17/42 42/14
8,984,786 B2 * 3/2015 Underwood ..... F41A 9/59 42/18
2004/0255766 A1 * 12/2004 Johnson ..... F41A 3/12 89/1.42
2005/0081707 A1 * 4/2005 Herring ..... F41A 5/26 89/33.14
2005/0183310 A1 8/2005 Finn
2010/0251591 A1 * 10/2010 Burt ..... F41A 17/42 42/70.01
2010/0275485 A1 * 11/2010 Findlay ..... F41A 35/06 42/16
2011/0056107 A1 * 3/2011 Underwood ..... F41A 9/59 42/18
2012/0167424 A1 * 7/2012 Gomez ..... F41A 35/06 42/14
2013/0152442 A1 * 6/2013 Underwood ..... F41A 9/59 42/6
2014/0060310 A1 * 3/2014 Overstreet ..... F41A 3/68 89/138
2015/0082678 A1 * 3/2015 Jacobson ..... F41A 9/65 42/8
2015/0323271 A1 * 11/2015 McGinty ..... F41A 35/06 42/17
2016/0116242 A1 * 4/2016 McGinty ..... F41A 35/06 42/16
2016/0123688 A1 * 5/2016 Faifer ..... F41A 9/65 42/50

FOREIGN PATENT DOCUMENTS

DE 202004002674 8/2005
EP 1566605 8/2005
WO 2013103428 7/2013

OTHER PUBLICATIONS

International Searching Authority, "International Search Report", issued in connection with PCT No. PCT/EP2013/002910, dated Dec. 17, 2013, 4 pages.
German Patent and Trademark Office, "Office Action", issued in connection with German Application No. 10 2012 019 422.6, dated Jul. 9, 2013, including English translation, 8 pages.
Patent Cooperation Treaty, "International Preliminary Report on Patentability," issued in connection with PCT Application No. PCT/EP2013/002910, issued on Apr. 7, 2015, 12 pages.

* cited by examiner

BOLT RELEASES AND FIREARMS INCLUDING SUCH BOLT RELEASES

RELATED APPLICATION

This patent is a continuation of International Patent Application Ser. No. PCT/EP2013/002910, filed Sep. 27, 2013, which claims priority to German Patent Application 10 2012 019 422.6, filed on Oct. 2, 2012, both of which are hereby incorporated herein by reference in their entireties.

FIELD OF THE DISCLOSURE

This patent relates generally to bolt releases and, more specifically, to bolt releases and firearms including such bolt releases.

BACKGROUND

Bolt catch levers and/or bolt releases are used in connection with firearms to catch and/or release a bolt of the firearm. Some weapons, such as light machine guns, submachine guns and/or pistols, include a bolt release that retains the bolt in an open position after the weapon fires its last cartridge. After the last cartridge has been fired, the marksmen may move the bolt release in front of the bolt to enable the bolt to be retained in a retained rearward position. When the bolt begins to move forward from the rearward position, the bolt engages the bolt release to retain the bolt in the retained rearward position.

After the marksmen inserts a full magazine into the magazine chamber, the marksmen may actuate the bolt release to release the bolt from the retained position and enable the bolt to travel and/or move toward the firing position. As the bolt moves forward toward the firing position, the bolt guides a cartridge into the cartridge chamber to ready the firearm for firing.

DETAILED DESCRIPTION

Figure 1:
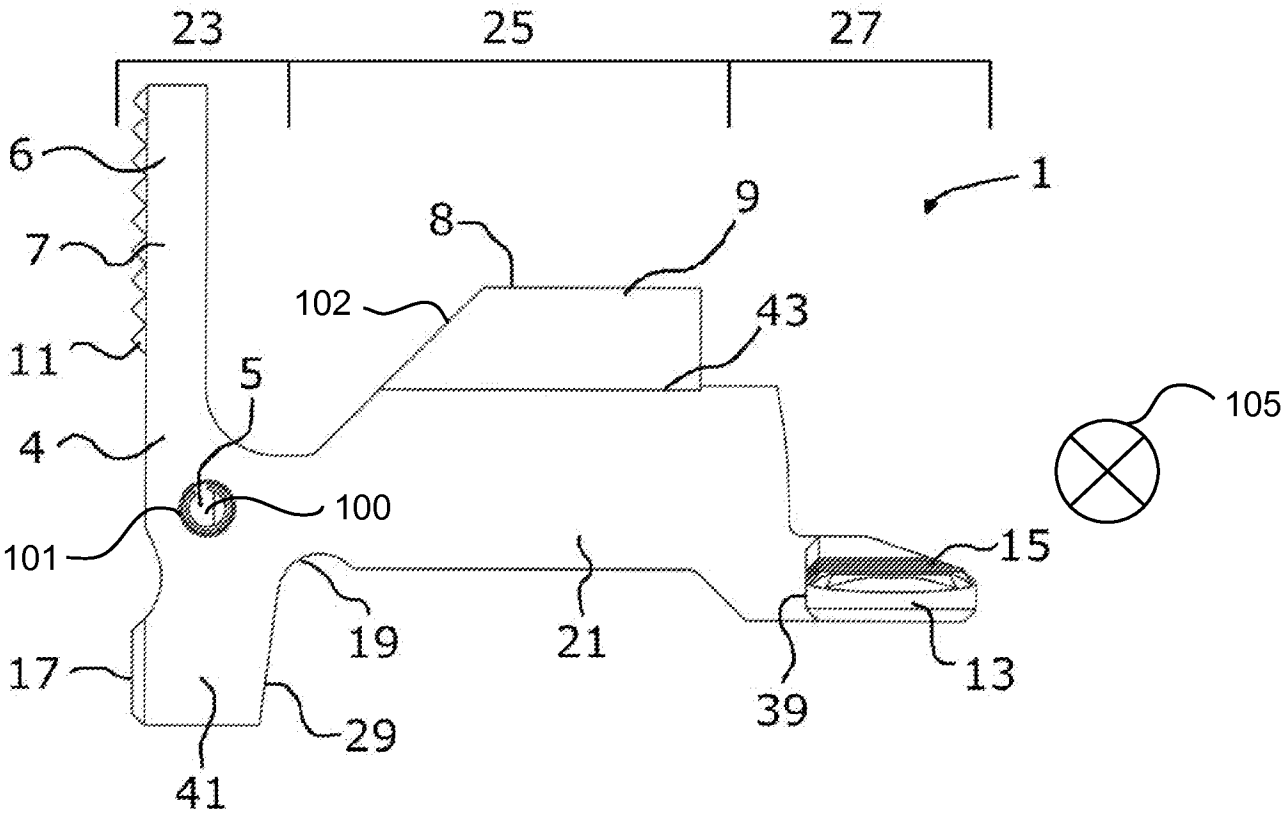
FIG. 1 illustrates an example bolt release in accordance with the teachings of this disclosure from the perspective of a shooter in the firing direction.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

Bolt catch levers and/or bolt releases are used in connection with firearms to retain a bolt of a firearm in a retained position after the firearm discharges its last cartridge. Automatically retaining the bolt in the retained position enables the marksmen to quickly notice when the magazine is empty and enables a cartridge to be loaded into the firearm after a full magazine is received without the marksman having to use the charging lever and/or slide of the firearm. Some right-handed marksmen actuate the bolt release using the free, left hand that is not located on the buttstock. Some bolt releases that are only operable from the left-side of the firearm are difficult for left-handed marksmen to operate.

Some bolt releases that are operable on both sides of the firearm include multiple components and have complex designs making such bolt releases prone to damage and/or malfunction when used in, for example, rough environments, combat and/or when exposed to contamination (e.g., dirt, mud, etc.). For example, U.S. Pat. No. 7,661,219, mentions a bolt release that is operable from both sides of the firearm using a multi-part rod construction; U.S. Patent Publication Ser. No. 2005/0183310 mentions a multi-component bolt release that is operable from both sides of the firearm using a rod that extends downwardly; and U.S. Patent Publication Ser. No. 2010/0275485 mentions a multi-component bolt release that is operable from both sides of the firearm, wherein the bolt release includes an extension and/or yoke that is attachable to a bolt release of the firearm using a pin.

In contrast to some of the examples mentioned above, the examples disclosed herein relate to example bolt releases for use with firearms, firearms and/or firearm portions (e.g., a lower receiver, a buttstock, etc.) including such example bolt releases. In some examples, the example bolt releases are operable from both sides of the firearm (e.g., the left side, the right side) and include handles that protrude from each side of the firearm to enable relatively easy actuation and/or operation of the example bolt releases. In some examples, the example bolt releases are integral and/or relatively integral.

FIG. 1 shows an example bolt release and/or bolt catch lever 1 in accordance with the teachings of this disclosure. For discussion purposes, FIG. 1 shows the example bolt release 1 having a first portion 23, a second portion 25 and a third portion 27 where the second portion 25 is disposed between and couples the first and third portions 23, 27. As shown in the example of FIG. 1 and from the perspective of the marksman in the direction of firing 105, the first portion 23 extends toward the left over a receiver to enable the example bolt release 1 to be operated from the left side of the firearm.

In operation, the example bolt release 1 can be pivoted about an axis and/or pivot axis 5 between a release position and a retaining position. In the release position, the bolt release 1 releases a bolt of a firearm for firing and, in the retaining position, the bolt release 1 retains the bolt in the retaining position to prevent the bolt from advancing forward to the firing position, for example.

In this example, to enable the bolt release 1 to be operated on the left side of the firearm, the first portion 23 includes a first handle 7 and a second handle 17. The first and second handles 7 and 17 are disposed on opposing ends of a lever and/or two-armed lever 4 that is pivotable in the clockwise and/or the counterclockwise direction. As shown in the example of FIG. 1, the lever 4 includes an upper and/or first section 6 and a lower and/or second section 41. In this example, surface structures 11 are provided on the first handle 7 and/or the second handle 17 for slip resistant purposes. The surface structures 11 may be, for example, ribs, checkers, texturing, rubber, a slip resistant coating, etc. In some examples, the bolt release 1 may be actuated using either the first handle 7 or the second handle 17.

To couple and/or support the bolt release 1 relative to and/or in a receiver and/or to provide the pivot point 5 for the bolt release 1, a pin, a locking pin, a cotter pin and/or axle 100 is disposed in a through hole 101 of a lower receiver 37 (see, FIGS. 2-7) and/or the bolt release 1. In some examples, a circular cotter pin interacts with the pin 101 to secure the pin 101 relative to the lower receiver 37 and/or to substantially ensure that the bolt release 1 remains coupled to the lower receiver 37.

In the illustrated example of FIG. 1, the second section 41 of the lever 4 includes a surface and/or planar surface 29 on a right lateral surface that transitions upward into a chamfer 19 at a transition between the first and second portions 23, 25 of the bolt release 1. In some examples, the chamfer 19 enables a reduced tolerance and/or play in the movement of the bolt release 1 as compared to a straight, non-chamfered edge and/or substantially reduces the likelihood of contaminants (e.g., dirt, mud, etc.) negatively affecting the performance of and/or the ability to pivot the bolt release 1.

Figure 4:
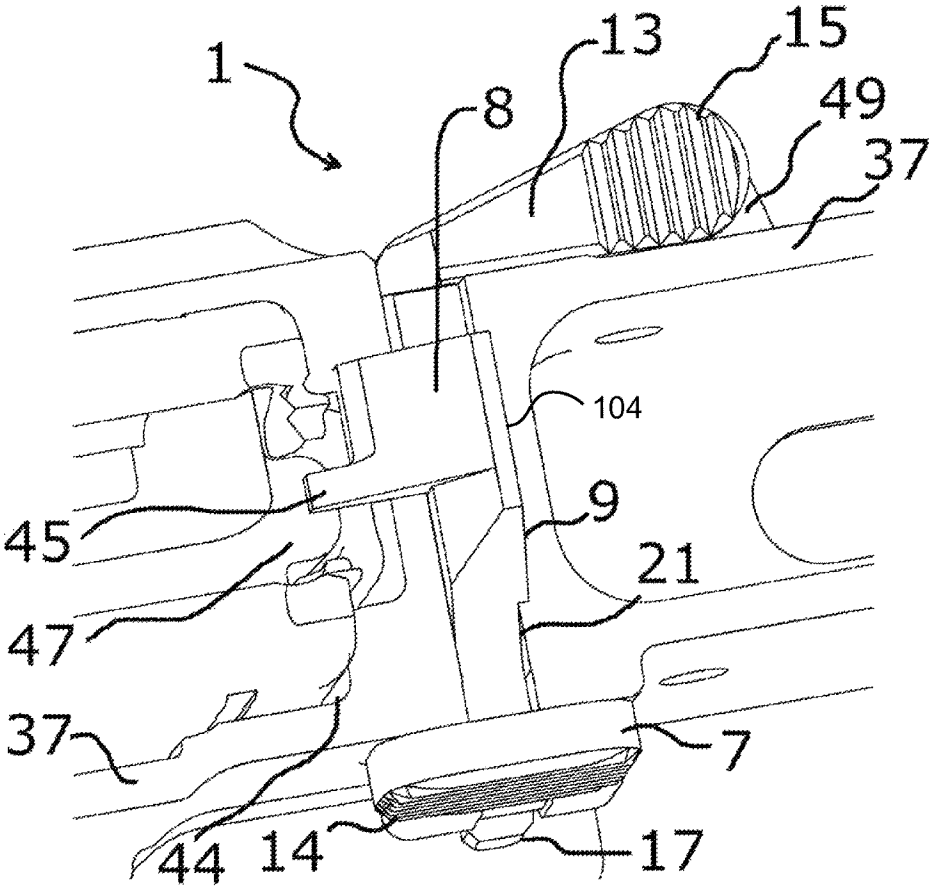
FIG. 4 is an isometric top view of the example bolt release of FIG. 1 in a retaining position disposed in an example receiver.
Figure 5:
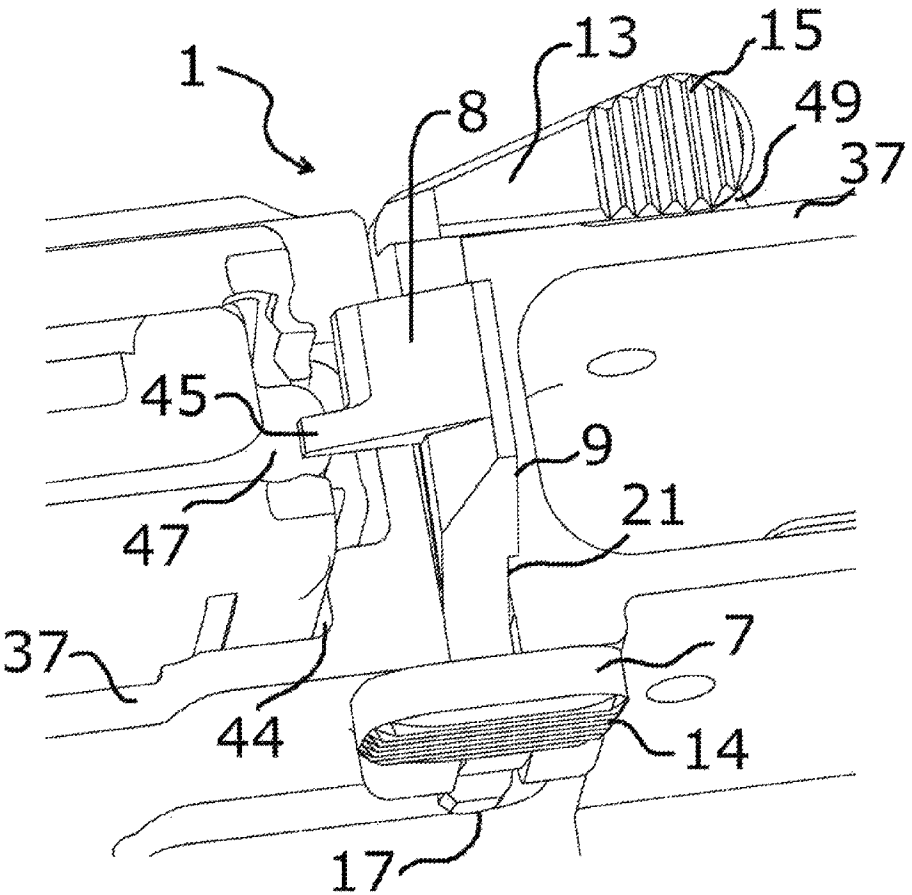
FIG. 5 is another isometric top view of the example bolt release of FIG. 1 in a retaining position disposed in an example receiver.
Figure 6:
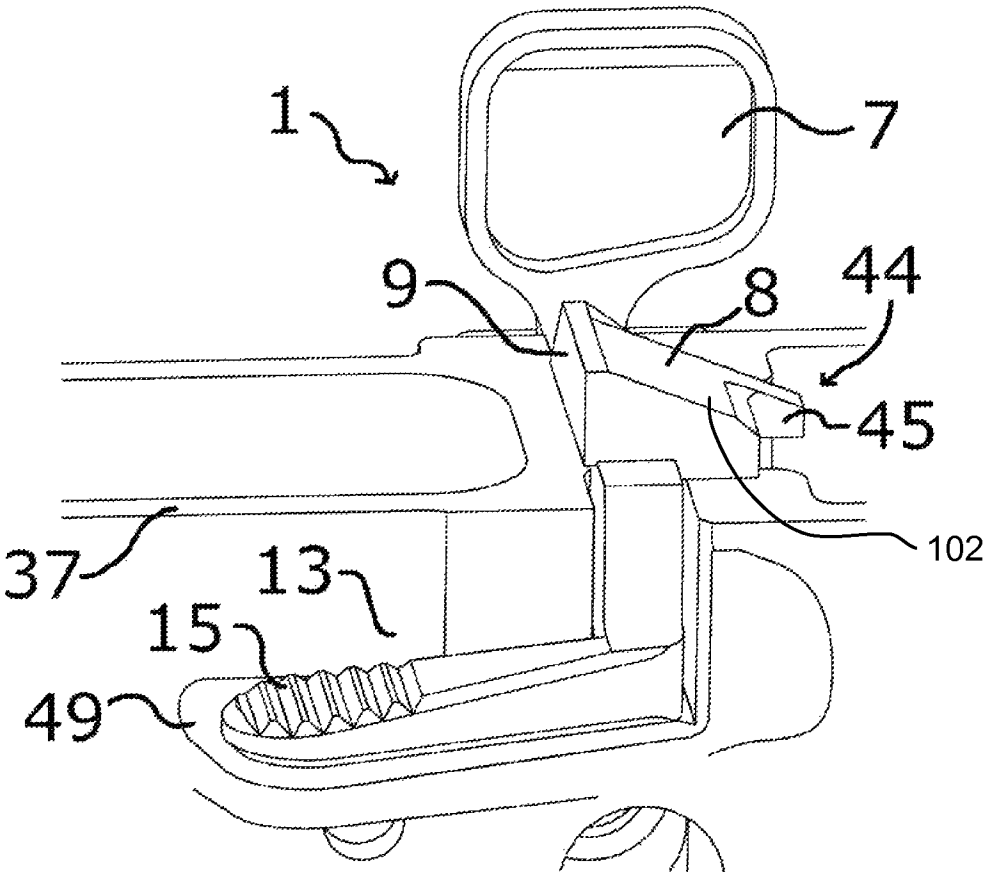
FIG. 6 is an isometric side view of the example bolt release of FIG. 1 in a retaining position disposed in an example receiver.

In the example of FIG. 1, the second portion 25 includes an elongated portion, a middle region and/or adjoining carrier 21 that, with the lever 4, forms a substantially T-shaped portion where the middle region 21 forms the "leg" of the "T" and the lever 4 forms the crossbar of the "T." However, in contrast to the shape of a "T," in some examples and as shown in FIGS. 4-6, the middle region 21 includes an upper, retention region 9 including a projection 8 having a ramp-like shape 102 (see, FIG. 6) that faces the marksman.

In operation, the bolt of the firearm bears against the retention region 9 when the bolt is in the retained and/or rearward position. When, for example, the bolt engages the retention region 9 of the bolt release 1, the bolt is retained in the retaining position until the bolt release 1 is actuated to the releasing position via the first handle 7, the second handle 17 and/or a third handle 13 against a spring force exerted onto a biased projection 31 via a spring 33 (see, FIGS. 2 and 3). In some examples, the bolt release 1 remains in the retaining position when the bolt engages the retention region 9 even when the magazine is removed from the magazine chamber.

Figure 2:
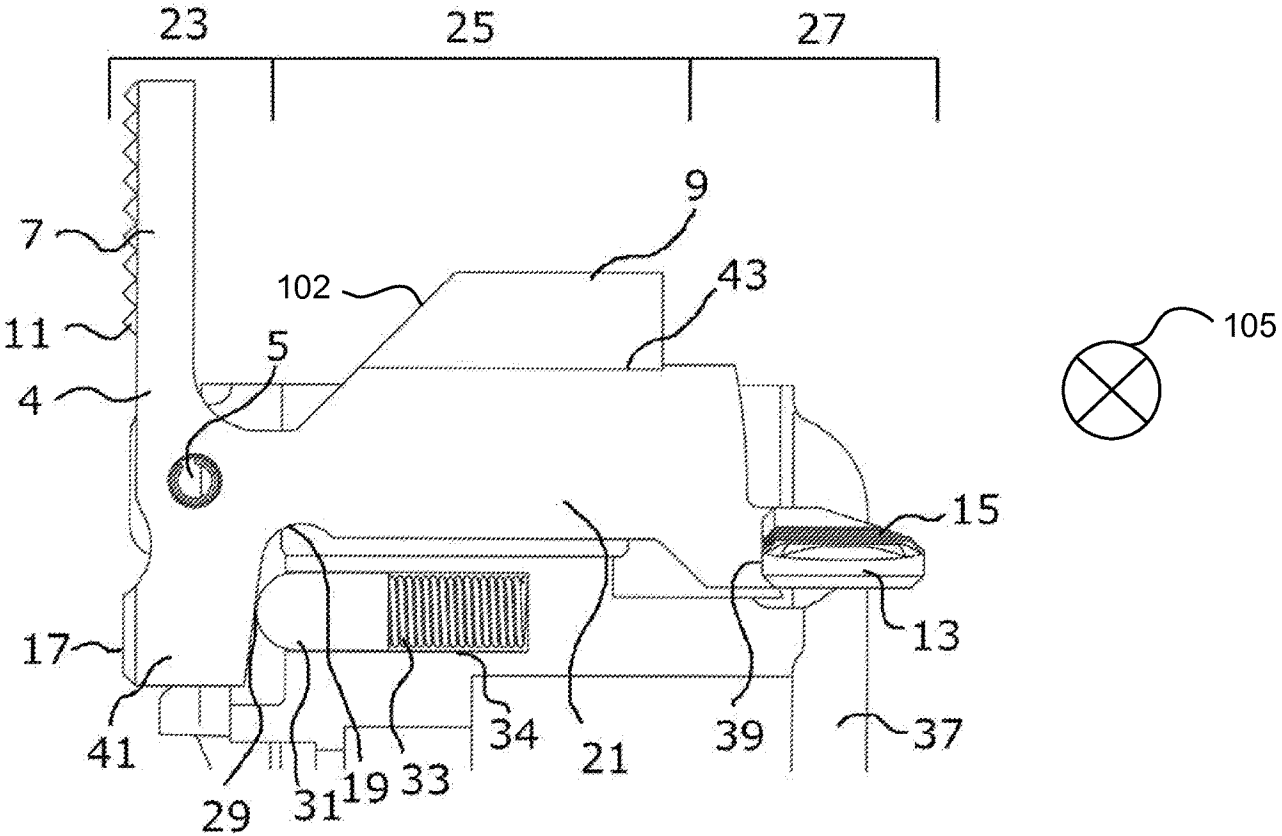
FIG. 2 illustrates the example bolt release of FIG. 1 in a release position disposed in an example receiver from the perspective of a shooter in the firing direction.

In the illustrated examples, the surface facing the shooter formed by the middle region 21 and the retention region 9 is substantially planar from the perspective of the marksman but includes an edge, shoulder and/or step 43 in the horizontal direction. In the example of FIG. 2, the edge 43 forms a shoulder that protrudes from the middle region 21 toward the marksman. For example, the edge 43 forms a protruding ledge between the surface of the middle region 21 and the surface of the retention region 9 on the projection 8. In some examples, the edge 43 and the surface of the retention region 9 form a stop and/or portion to be engaged by a plug. The engagement between the stop and the plug may, for example, substantially protect the lower receiver 37 and/or the upper receiver from damage.

As shown in the example of FIG. 1, the projection 8 includes the ramp 102 that descends in a firing direction and/or toward the magazine chamber 44 (see, FIGS. 4-6). As shown in the example of FIG. 4, in some examples, the ramp 102 transitions into a tooth, nose shaped button and/or protrusion 45 in the direction of firing. In some examples, the button 45 engages with a portion of the cartridge loader 47 extending toward a back of an empty magazine (see, FIGS. 4-6).

As shown in the example of FIGS. 1 and 4, for example, the bolt release 1 includes the third handle 13 in the third portion 27. In this example, the third handle 13 includes ribbing, slip resistant material(s) and/or surface structures 15. However, in other examples, the third handle 13 may not include the surface structures 15. In some examples, a longitudinal axis of the third handle 13 is substantially parallel to an axis of the bore/barrel of the firearm. As used herein, the phrase substantially parallel means between about +/−3 degrees of parallel and/or substantially accounts for manufacturing tolerances. As more clearly shown in FIGS. 4 and 5, the third handle 13 and/or lateral surfaces 39 of the third handle 13 extends substantially perpendicularly relative to the planar surface of the middle region 21. As used herein, the phrase substantially perpendicular means between about +/−3 degrees of perpendicular and/or substantially accounts for manufacturing tolerances.

Figure 3:
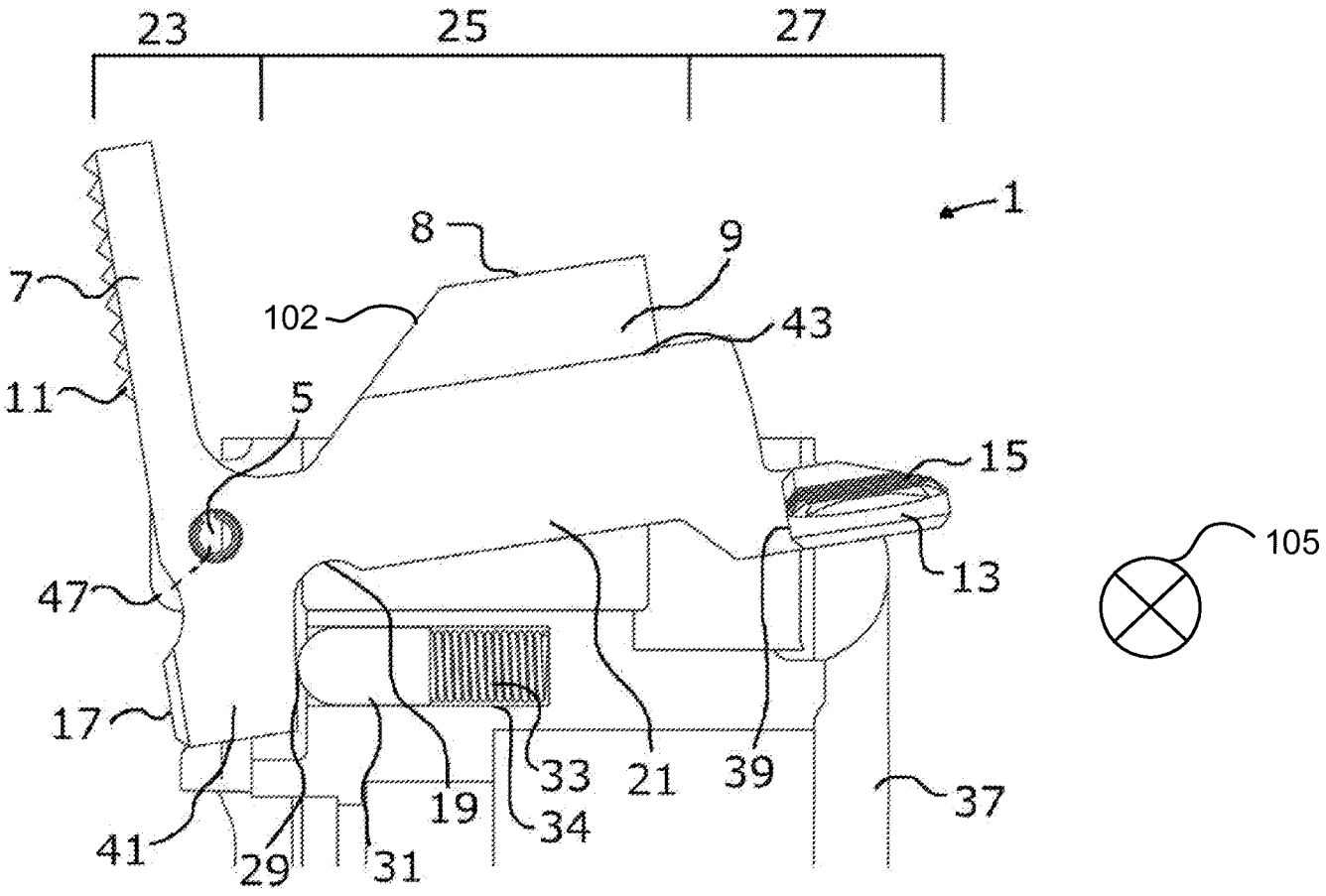
FIG. 3 illustrates the example bolt release of FIG. 1 in a retaining position disposed in an example receiver from the perspective of a shooter in the firing direction.

The examples of FIGS. 2-5 illustrate the example bolt release 1 disposed in the lower receiver 37 where FIGS. 2 and 4 show the bolt release 1 in the release position and FIGS. 3 and 5 show the bolt release 1 in the retention position. In the illustrated examples, the magazine chamber 44 is positioned in front of the bolt release 1 and, in some examples, a trigger assembly and/or device may be disposed behind the bolt release 1.

Referring to FIGS. 2 and 3, the biased projection and/or pin 31 is disposed in a recess, aperture and/or blind hole 34 defined by the lower receiver 37. In this example, the biased projection 31 opposes the surface 29 of the second section 41 and includes a rounded and/or tapered head that engages the surface 29. To bias the biased projection 31 toward the surface 29 and to urge the bolt release 1 toward the release position, a spring and/or biasing element 33 is disposed in the aperture 34.

Referring to the example of FIG. 5, the bolt release 1 is illustrated in the retention position and the cartridge loader 47 of an empty magazine is shown engaging the button 45 of the bolt release 1. In some examples, a spring urges the cartridge loader 47 and, in turn, the button 45 upward. In this example, based on the coupling and/or integral nature of the button 45 and the bolt release 1, pivoting the button 45 also pivots and/or moves the bolt release 1 about the pivot axis 5 from the release position to the retention position. When the bolt release 1 is disposed in the retention position, engagement between the surface 29 and the biased projection 31 moves the biased projection 31 into the aperture 34 against the spring force of the spring 33. Additionally and/or alternatively, the biased projection 31 may be moved into the aperture 34 if a force is exerted against on the second handle 17 toward the biased projection 31 and/or if a person moves the second handle 17 toward and/or into engagement with the biased projection 31. When the bolt release 1 is positioned in the retention position, the retention region 9 is disposed in the path of the bolt of the firearm. Specifically, the retention region 9 is pivoted upward to be within the path of the bolt.

In operation, after a shot is fired from the firearm, the bolt travels over the ramp 102 of the projection 8 during the recoil process toward the marksman and/or buttstock and forces and/or moves the bolt release 1 to the release position and against and/or counter to the spring force of the cartridge loader 47 within the magazine.

When the magazine is empty, after the bolt passes over the bolt release 1, the bolt release 1 pivots to the retention position. The bolt travels rearwardly during the recoil process against the spring force of the recoil springs until rearward travel of the bolt stops and/or the force of the recoil springs urge the bolt back toward the firing direction. As the bolt moves toward the firing direction, an end of the bolt engages a planar surface 104 of the retention region 9 thereby retaining the bolt in the rearward position.

When the bolt is disposed in the rearward position, the marksman may release the empty magazine using a magazine release and remove the magazine from the magazine chamber. The cartridge loader 47 disengages the button 45 when the magazine is removed. After the cartridge loader 47 disengages the button 45, the bolt release 1 remains in the retained positioned based on the bolt being driven against the retention surface 9 by the recoil spring(s). Thus, the bolt release 1 and the bolt are retained in the rearward and/or retained position and the marksman may insert a loaded magazine into the magazine chamber 44 while the bolt is retained in the rearward position.

After the loaded magazine is inserted into the magazine chamber 44, the bolt release 1 may be moved to the released position by pivoting the bolt release 1 to the released position. For example, the marksman can move the first handle 7 toward the lower receiver 37 and/or the marksman can move the third handle 13 toward a projection (e.g. a protective projection) 49 to pivot the bolt release 1 to the release position. By moving the bolt release 1 to the release position, the bolt is released and enables the bolt to travel in the direction of firing under the influence of the recoil springs. As the bolt moves forward, a new cartridge is guided out of the magazine and into the cartridge chamber to ready the firearm for firing. To retain the bolt release 1 in the release position, the biased projection 31 acts against the surface 29 of the bolt release 1. When the magazine is empty, in some examples, the cartridge loader 47 engages the button 45 to pivot the bolt release 1 and/or the bolt release 1 is manually pivoted to enable the bolt release 1 to retain the bolt in the retained position.

The illustrated example of FIG. 6 shows a side isometric view of the bolt release 1 disposed in the lower receiver 37 with the bolt release 1 in the release position. In some examples, the projection 49 is formed on the lower receiver 37 and substantially laterally projects, for example, substantially perpendicularly, from the lower receiver 37. However, the projection 49 may project from the lower receiver 37 at any suitable angle. In some examples, the projection 49 is coupled (e.g., removably coupled, permanently coupled, etc.) to the lower receiver 37 in different ways. As shown in the example of FIG. 6, to protect the bolt release 1 when the bolt release 1 is in the released position, the third handle 13 is proximate and/or adjacent the projection 49. When the example bolt release 1 is in the retained position, the third handle 13 is pivoted away from the projection 49 and/or spaced from the projection 49.

The examples disclosed herein relate to example ambidextrous bolt releases and firearms and/or firearm components (e.g., lower receiver, buttstock, etc.) that include such bolt releases. The example bolt releases are reliably constructed to operate from both the right side of the firearm and the left side of the firearm.

In some examples, the bolt release is attached and/or coupled to a firearm in an articulating manner such that the bolt release can be pivoted about a pivot axis between a release position and a retention position. In some examples, the example bolt release is incorporated with and/or included with an example firearm.

In some examples, an example receiver used in connection with the examples disclosed herein is a one-piece receiver and/or a muli-piece receiver including, for example, an upper receiver and a lower receiver. Regardless of the type of receiver used, the example bolt releases may be provided in the appropriate position to, for example, retain the bolt in the rearward position after the last cartridge has been fired. In some examples, the lower receiver is configured and/or designed as a buttstock module, a buttstock module including a magazine chamber to receive a magazine, a buttstock module having a chamber and/or receiver for a trigger device and/or apparatus, a buttstock module including a magazine chamber and a chamber and/or receiver for a trigger device and/or apparatus, a buttstock module including a chamber and/or receiver for a trigger device and/or apparatus and a shoulder rest and/or a buttstock module including a magazine chamber, a chamber and/or receiver for a trigger device and/or apparatus and a shoulder rest.

In some examples, the example bolt release has an integral construction, thereby simplifying the construction of the example bolt releases and the reliability (e.g., fail-safe construction and/or operation) of firearms that include such example bolt releases. In some examples, the example bolt releases can be cost-effectively produced using metal casting processes and/or metal powder injection processes (e.g., metal injection molding (MIM) methods) using, for example, sintering processes.

In some examples, the pivot axis of the example bolt releases can be disposed on either the right side of the firearm or the left side of the firearm, thereby decreasing a lever path (e.g., a lever stroke path) and/or reducing the likelihood that the example bolt release is unintentionally actuated. In some examples, the example bolt release is biased toward the release position. For example, the bolt and/or pin may bias the bolt release toward the release position. To enable the bolt release to be retained in the release position in an elastic pre-tensioned manner, the bolt release may be biased toward the release by a spring, a rubber-like component, an elastic element, etc.

In some examples, the release position of bolt release is a position that enables the bolt to move back and forth during the firing process unimpeded. In some examples, the bolt release pivots toward a retained position after the last cartridge of a magazine has been fired to substantially block and/or prevent the bolt from moving past the bolt release when there is no cartridge to move into the cartridge chamber.

In some examples, the bolt release preferably includes a button and/or projection that extends into the magazine chamber such that a cartridge loader under the influence of a spring engages the button when the magazine is empty. In some examples, the engagement between the button and the cartridge loader automatically and/or substantially automatically moves and/or rotates the bolt release from the release to the retaining position.

The button to be engaged by the cartridge loader can be differently designed. For examples, the button may configured as a nose, a tooth, a projection, a ramped surface, a ramp shape at an upper front surface of the button, etc. In some examples, the shape and/or configuration of the button substantially ensures that as the bolt rearwardly moves after a round is fired, the bolt and/or a back edge of the bolt does not catch and/or jam on a front surface of the bolt release. In some examples, the button extends into the back upper side of the magazine to enable contact and/or engagement with the cartridge loader but substantially does not engage a base of a cartridge (e.g., a cartridge in the magazine) to enable the free flow and/or the unimpeded supply of cartridges during firing, etc.

In some examples, the cartridge loader preferably includes an extended portion and/or region that extends beyond a base of a cartridge to enable the cartridge loader but not a cartridge itself to come into contact with and/or engage the button on the example bolt release. In some examples, the extension of the cartridge loader and the spring acting on the cartridge loader transfers the spring force to the button and/or enables the bolt release to be pivoted to and/or toward the retention position when the cartridge loader engages the button of the example bolt release. In some examples, the button substantially ensures that, when the magazine is empty, the bolt release reliably moves to the retained position to retain the bolt in the retained and/or rearward position. When the bolt is retained in the rearward position, the marksman is alerted that the magazine is empty and that the magazine should be replaced.

In some examples, the example bolt release preferably includes three levers to operate and/or actuate the bolt release. For example, two of the handles may be disposed proximate the pivot axis and a third handle may be disposed distal to the pivot axis as compared to the other two handles.

In some examples, the example bolt release preferably can be actuated between the retained position to the release position by exerting pressure on and/or by moving one or more of the handles on the bolt release.

In some examples, the pivot axis and/or a bore of the pivot axis of the example bolt release preferably is disposed between the two handles proximate the pivot axis. In some examples, the handles have a similar or the same length to enable the example bolt release to be easily operated while maintaining and/or having a compact construction. In some examples, the handles have a different length to enable the example bolt release to be easily operated while maintaining and/or having a compact construction.

In some examples, a marksman can actuate and/or move the example bolt release from the retained position to the release position by pushing an end of the bolt release proximate the pivot axis inward and/or by pushing another handle of the bolt release downwardly, for example.

In some examples, the marksman actuates the example bolt release using one of the handles after an empty magazine has been replaced with a full magazine to enable the bolt to be moved from the retained and/or rearward position to the firing and/or forward position. When the bolt release is disposed in the release position, the bolt may move forwardly and rearwardly to move cartridges from the magazine into the cartridge chamber in an uninterrupted manner. Using the examples disclosed herein, a marksman may reload a firearm including the example bolt release using the one hand (e.g., the hand not located on the buttstock) and the example bolt release may be actuated using this free hand (e.g., the hand not located on the buttstock). The examples disclosed herein enable the example bolt release to be ergonomically operated from the left side of the firearm and the right side of the firearm.

In some examples, the example bolt release includes another handle that may be used to manually pivot the bolt release into the retained position by, for example, the marksman. Using such an example bolt release, a marksman may manually move the bolt release to a retained position to catch and/or retain the bolt in the rearward position to, for example, perform a safety check of the firearm (e.g., verify that the firearm is unloaded), to clean the firearm, etc.

In some examples, the example bolt release may include a slip-resistant surface and/or structures. The slip-resistant surface and/or structures may include recesses, grooves, a rubber coating, a coating, surface pattern(s), etc. In some examples, the slip-resistant surfaces and/or structures enable a marksman to safely and/or properly operate the example bolt release without slipping occurring when the marksman is wearing gloves, in adverse condition (e.g., snow, rain, mud, etc.).

In some examples, the example bolt release may be configured and/or used to retrofit an existing firearm. In some examples, the example bolt release is constructed to be of a reduced sized and/or to be easily implemented in exiting buttstocks and/or receivers (e.g., lower receivers). In some examples, a slot may be formed in a receiver and/or buttstock using a machine (e.g., a milling machine) to enable the example bolt release to be disposed therein. Using such an example retrofitting process, rifles such as the M16 may be retrofitted to include the example bolt release as disclosed herein. In some examples, other rifles (e.g., older rifles) can be retrofitted using the example bolt release disclosed herein in a cost-effective manner.

In some examples, the example bolt release may be included as a component of a receiver and/or a lower receiver and/or a firearm. In some examples, firearms are constructed as individual assemblies to enable defective components to be identified and/or easily replaced. In some examples, the example bolt release may be a component that is included with firearms and/or firearm assemblies.

In some examples, the receiver and/or lower receiver includes a portion that is configured to protect the example bolt release from damage (e.g., bending, breaking) and/or to protect one or more handles of the bolt release when, for example, the firearm is dropped. In some examples, such a portion substantially prevents against unintentional actuation of the bolt release. In some examples, the portion is provided when manufacturing the receiver and is, for example, a molded portion of the receiver. Alternatively, the portion (e.g., the handle protective portion) may be coupled and/or attached to the receiver. In some examples, the protective portion may substantially prevent against the unintentional actuation of the bolt release. Unintentionally actuating the bolt release may negatively impact the firearm.

In some examples, an example handle of the bolt release may extend toward the marksman at an angle of between about 70°-110° relative to the receiver and, in some examples, may extend substantially perpendicularly relative to the receiver. In some examples, one or more of the handles are ergonomically, comfortably and/or easily located to enable easy operation and/or actuation. In some examples, one or more of the handles are disposed to substantially prevent the handles from becoming caught in the marksman's clothing, etc., thereby further decreasing the likelihood of accidental actuation.

The examples disclosed herein relate to example bolt releases for firearms, buttstocks and/or receivers and/or firearms, buttstocks and/or receivers including such example bolt releases. The examples disclosed herein relate to example bolt releases that can be operated ambidextrously from either side of the firearm using handles that extend from either side of the firearm. The example bolt release may have an integral design.

As set forth herein, an example bolt catch lever 1 for a firearm that can operated from both sides and for this purpose has handles 7, 13, 17 protruding on both sides of the firearm, and is designed as an integral part thereof, where the bolt catch lever 1 is attached in an articulated manner to a pivot axis 5 disposed on one side such that it can pivot between a release position and a catch/retention position on the firearm. In some examples, the bolt catch lever 1 is supported such that the bolt catch lever 1 is retained in the release position by an elastic element 33. In some examples, the bolt catch lever 1 includes a button 45 protruding from the bolt catch lever 1, where the button 45 extends into a magazine chamber 44 such that the button 45 becomes engaged with a cartridge loader 47 of an empty magazine and, with the aid of a magazine spring, moves the bolt catch lever 1 from the release position into the catch/retention position.

In some examples, the bolt catch lever 1 includes two handles 7, 17 on an end of the bolt catch lever 1 in the proximity of the pivot axis 5, and a third handle 13 on an end of the bolt catch lever 1 further away from its pivot axis 5. In some examples, the bolt catch lever 1 can be moved from the catch/retention position to a release position by exerting pressure on one of the handles 7, 13. In some examples, the bolt catch lever 1 can be moved from a release position to a catch/retention position by actuating one of the handles 13, 17. In some examples, at least one of the handles 7, 13, 17 includes a slip-resistant surface 11. In some examples, the bolt catch lever 1 is designed as a retrofitting kit for firearms. In some examples, a buttstock for a firearm includes the bolt catch lever 1 as disclosed herein. In some examples, a receiver 37 includes the bolt catch lever 1 as disclosed herein. In some examples, the receiver 37 includes at least one protective projection 49 for at least one handle 13, 17 of the bolt catch lever 1.

The examples disclosed herein relate to a bolt catch lever 1 for a firearm that can be operated from both sides of the firearm. In some examples, the bolt catch lever 1 has handles 7, 13, 17 protruding from both sides of the firearm, and is designed as an integral part thereof, as well as a buttstock for a firearm, and a receiver, equipped, respectively, with a bolt catch lever 1 of this type.

As set forth herein, an example bolt release for use with a firearm includes a first handle to protrude from a first side of the firearm and a second handle to protrude from a second side of the firearm. The first and second handles are integral. The first and second handles are to enable the bolt release to be operable from the first and second sides of the firearm. The bolt release includes a pivot axis adjacent the first side or the second side. The pivot axis is to enable the bolt release to be pivoted between a release position and a retained position.

In some examples, the bolt release is to be biased toward the release position by a spring. In some examples, the bolt release includes a protrusion to extend into a magazine chamber of the firearm, the protrusion to be engaged by a cartridge loader of a magazine when the magazine is empty, the engagement between the protrusion and the cartridge loader to actuate the bolt release from the release position to the retained position. In some examples, bolt release includes a third handle. In some examples, the first and third handles are proximate the pivot axis and the second handle is distal to the pivot axis. In some examples, the bolt release is to be actuated between the release position and the retained position using the first handle, the second handle or the third handle. In some examples, the bolt release is to be actuated from the release position to the retained position using the first handle, the second handle or the third handle. In some examples, the bolt release is to be actuated from the retained position to the release position using the first handle, the second handle or the third handle. In some examples, the bolt release includes a retrofit bolt release.

An example firearm includes a receiver; and a bolt release disposed in the receiver. The bolt release includes a first handle to protrude from a first side of the firearm and a second handle to protrude from a second side of the firearm. The first and second handles are integral. The first and second handles are to enable the bolt release to be operable from the first and second sides of the firearm. The bolt release includes a pivot axis adjacent the first side or the second side. The pivot axis to enable the bolt release to be pivoted between a release position and a retained position. In some examples, the bolt release is to be biased toward the release. In some examples, the bolt release includes a protrusion to extend into a magazine chamber of the firearm, the protrusion to be engaged by a cartridge loader of a magazine when the magazine is empty, the engagement between the protrusion and the cartridge loader to actuate the bolt release from the release position to the retained position. In some examples, bolt release includes a third handle. In some examples, the first and third handles are proximate the pivot axis and the second handle is distal to the pivot axis. In some examples, the bolt release is to be actuated between the release position and the retained position using the first handle, the second handle or the third handle. In some examples, the bolt release is to be actuated from the release position to the retained position using the first handle, the second handle or the third handle. In some examples, the bolt release is to be actuated from the retained position to the release position using the first handle, the second handle or the third handle. In some examples, the first handle includes surface structures or a slip-resistant coating.

An example receiver includes a lower receiver and a bolt release disposed in the lower receiver. The bolt release includes a first handle to protrude from a first side of the lower receiver and a second handle to protrude from a second side of the lower. The first and second handles are integral. The first and second handles are to enable the bolt release to be operable from the first and second sides of the lower receiver. The bolt release includes a pivot axis adjacent the first side or the second side. The pivot axis is to enable the bolt release to be pivoted between a release position and a retained position. In some examples, the lower receiver includes a protrusion to substantially protect the first handle or the second handle against damage or accidental actuation. In some examples, in the release position, the bolt release is to enable a bolt of a firearm to oscillate between a rearward position and a forward position and, in the retained position, the bolt release to retain the bolt adjacent the rearward position.

An example bolt release for use with a firearm includes a first handle to protrude from a first side of the firearm and a second handle to protrude from a second side of the firearm. The first and second handles are to enable the bolt release to be operable from the first and second sides of the firearm. The example bolt release also includes an elongated portion coupling the first and second handles. A chamfer is defined between the first handle and the elongated portion to substantially reduce a likelihood of contaminants affecting a pivotal movement of the bolt release. A pivot axis is defined adjacent the chamfer and the first lever. The pivot axis is to enable the bolt release to be pivoted between a release position and a retained position. The bolt release is to be biased toward the release position. The first handle, the second handle and the elongated portion being integral. A protrusion is to extend into a magazine chamber of the firearm. The protrusion is to be engaged by a cartridge loader of a magazine when the magazine is empty. The engagement between the protrusion and the cartridge loader to actuate the bolt release from the release position to the retained position.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. A bolt release for use with a firearm, comprising:

a first handle to protrude from a first side of the firearm;

a second handle to protrude from a second side of the firearm, the first and second handles being integral, the first and second handles to enable the bolt release to be operable from the first and second sides of the firearm, wherein the bolt release comprises a pivot axis adjacent the first side or the second side, the pivot axis to enable the bolt release to be pivoted between a release position and a retained position, the bolt release including a surface structured to be engaged by a spring or a spring-biased follower to bias the bolt release toward the release position.

2. The bolt release of claim 1, wherein the bolt release comprises a protrusion to extend into a magazine chamber of the firearm, the protrusion to be engaged by a cartridge loader of a magazine when the magazine is empty, the engagement between the protrusion and the cartridge loader to actuate the bolt release from the release position to the retained position.

3. The bolt release of claim 1, further comprising a third handle, wherein the first and third handles are proximate the pivot axis and the second handle is distal to the pivot axis, outward facing surfaces of the first and third handles being substantially co-planer.

4. The bolt release of claim 3, wherein the bolt release is to be actuated between the release position and the retained position using the first handle, the second handle, or the third handle.

5. The bolt release of claim 4, wherein the bolt release is to be actuated from the release position to the retained position using the first handle, the second handle, or the third handle.

6. The bolt release of claim 4, wherein the bolt release is to be actuated from the retained position to the release position using the first handle, the second handle, or the third handle.

7. The bolt release of claim 1, wherein the first handle comprises surface structures or a slip-resistant coating.

8. The bolt release of claim 1, wherein the bolt release comprises a retrofit bolt release.

9. A firearm, comprising:

a receiver; and a bolt release disposed in the receiver, the bolt release comprising:

a first handle to protrude from a first side of the firearm;

a second handle to protrude from a second side of the firearm, the first and second handles being integral, the first and second handles to enable the bolt release to be operable from the first and second sides of the firearm, wherein the bolt release comprises a pivot axis adjacent the first side or the second side, the pivot axis to enable the bolt release to be pivoted between a release position and a retained position, the receiver defining a lateral bore receiving a spring, the spring biasing the bolt release toward the release position.

10. The firearm of claim 9, wherein the bolt release comprises a protrusion to extend into a magazine chamber of the firearm, the protrusion to be engaged by a cartridge loader of a magazine when the magazine is empty, the engagement between the protrusion and the cartridge loader to actuate the bolt release from the release position to the retained position.

11. The firearm of claim 9, further comprising a third handle, wherein the first and third handles are proximate the pivot axis and the second handle is distal to the pivot axis, outward facing surfaces of the first and third handles being substantially co-planer.

12. The firearm of claim 11, wherein the bolt release is to be actuated between the release position and the retained position using the first handle, the second handle, or the third handle.

13. The firearm of claim 11, wherein the bolt release is to be actuated from the release position to the retained position using the first handle, the second handle, or the third handle.

14. The firearm of claim 11, wherein the bolt release is to be actuated from the retained position to the release position using the first handle, the second handle, or the third handle.

15. The firearm of claim 9, wherein the first handle comprises surface structures or a slip-resistant coating.

16. A receiver, comprising:

a lower receiver;

a bolt release disposed in the lower receiver, the bolt release comprising:

a first handle to protrude from a first side of the lower receiver; and a second handle to protrude from a second side of the lower receiver, the first and second handles being integral, the first and second handles to enable the bolt release to be operable from the first and second sides of the lower receiver, wherein the bolt release comprises a pivot axis adjacent the first side or the second side, the pivot axis to enable the bolt release to be pivoted between a release position and a retained position, a spring urging the bolt release, via the first handle, toward the release position.

17. The receiver of claim 16, wherein the lower receiver comprises a protrusion to substantially protect the first handle or the second handle against damage or accidental actuation.

18. The receiver of claim 16, wherein, in the release position, the bolt release is to enable a bolt of a firearm to oscillate between a rearward position and a forward position, in the retained position, the bolt release to retain the bolt adjacent the rearward position.

19. A bolt release for use with a firearm, comprising:

a first handle to protrude from a first side of the firearm;

a second handle to protrude from a second side of the firearm, the first and second handles to enable the bolt release to be operable from the first and second sides of the firearm, the first handle including a surface structured to be engaged by a spring or a spring-biased follower to bias the bolt release toward a release position;

an elongated portion coupling the first and second handles, wherein a chamfer is defined between the first handle and the elongated portion to substantially reduce a likelihood of contaminants affecting a pivotal movement of the bolt release, a pivot axis is defined adjacent the chamfer and the first handle, the pivot axis to enable the bolt release to be pivoted between a release position and a retained position, the bolt release is to be biased toward the release position, the first handle, the second handle, and the elongated portion being integral; and a protrusion to extend into a magazine chamber of the firearm, the protrusion to be engaged by a cartridge loader of a magazine when the magazine is empty, the engagement between the protrusion and the cartridge loader to actuate the bolt release from the release position to the retained position.

20. The firearm of claim 9, further including a projection coupled to the spring, the projection being urged into engagement with the bolt release, via the spring, to bias the bolt release toward the release position.

21. The firearm of claim 20, wherein the projection includes a tapered or rounded end engaging the bolt release to bias the bolt release toward the release position.

22. The firearm of claim 1, wherein the surface is a planar surface.

23. The receiver of claim 16, wherein the lower receiver defines a bore in which the spring or the spring-biased follower are disposed.

* * * * *